United States Patent [19]

Chaney et al.

[11] Patent Number: 4,593,775

[45] Date of Patent: Jun. 10, 1986

[54] TWO-PIECE PRESSURE RELIEF VALVE

[75] Inventors: John P. Chaney, Huntington Beach; William Van De Nobelen, Placentia, both of Calif.

[73] Assignee: Smith International, Inc., Newport Beach, Calif.

[21] Appl. No.: 724,428

[22] Filed: Apr. 18, 1985

[51] Int. Cl.[4] ..... E21B 10/22

[52] U.S. Cl. ..... 175/228; 175/371; 184/54

[58] Field of Search ..... 384/93, 94; 175/227, 175/228, 371, 372; 184/39, 54

[56] References Cited

U.S. PATENT DOCUMENTS

| | | | |
|---|---|---|---|
| 3,917,028 | 11/1975 | Garner | 175/228 |
| 4,055,225 | 10/1977 | Millsapps | 175/228 |
| 4,161,223 | 7/1979 | Oelke | 175/228 |
| 4,183,416 | 1/1980 | Walters | 175/371 |
| 4,248,484 | 2/1981 | Newcomb | 384/94 |
| 4,274,498 | 6/1981 | Penny | 175/228 |
| 4,276,946 | 7/1981 | Millsapps, Jr. | 175/228 |
| 4,388,984 | 6/1983 | Oelke | 184/54 |
| 4,407,375 | 10/1983 | Nakamura | 175/228 |
| 4,448,268 | 5/1984 | Fuller | 175/228 |
| 4,501,338 | 2/1985 | Underwood | 384/93 |

*Primary Examiner*—Stephen J. Novosad
*Assistant Examiner*—Bruce M. Kisliuk
*Attorney, Agent, or Firm*—Robert G. Upton

[57] ABSTRACT

A pressure compensating lubricant reservoir system is disclosed for a rotary cone rock bit. The system comprises a two-piece canister and flexible boot, one side of the boot being vented to the dome area of the bit. An O-ring is utilized adjacent the reservoir cover cap to seal the lubricant within the reservoir cavity. In order to prevent damage to the O-ring, the cover cap part of the canister forms a circumferential groove therearound to accept the O-ring. An intermediate disc is trapped between the cover cap and the resilient boot and serves to close out the O-ring groove in the cover cap.

With a prior art one-piece canister, the O-ring is put into position in a groove formed by the canister, followed by insertion of the canister into a lubricant cavity formed by the bit body. Damage to the O-ring often occurs when the outer peripheral edge of the O-ring passes by a cover cap snap ring retention slot at the reservoir cavity entrance.

The O-ring can now be placed in the reservoir cavity without damage to the ring.

15 Claims, 3 Drawing Figures

TWO-PIECE PRESSURE RELIEF VALVE

BACKGROUND OF THE INVENTION

1. Field of the Invention

This invention relates to a pressure relief system for a lubrication reservoir for sealed bearing rotary cone rock bits.

More particularly, this invention relates to a two-piece canister for a lubricant reservoir for a sealed bearing rock bit, the reservoir being vented through the dome of the rock bit.

2. Description of the Prior Art

There are a number of prior art references relating to pressure relief systems for lubricant reservoirs for sealed bearing rock bits.

U.S. Pat. No. 4,055,225, issued to Hughes Tool Company, teaches a lubricant pressure compensator system for an earth boring drill bit for equalizing the lubricant pressure with the ambient or borehole pressure. The pressure compensator is located in a lubricant reservoir that has a passage leading out of the bit adjacent the discharge nozzle. A flexible diaphragm is located in the reservoir with its lip sealed against the base of the reservoir. The lip protrudes outwardly and a protector member bears downwardly against the lip. A cap bears against the protective member in pressing the lip. A retainer snap ring holds the cap with the lip under compression. The groove for the snap ring is formed in the body of the rock bit. A protective centering disc is attached to the center of the diaphragm. An O-ring groove is formed in the bit body below the snap ring groove to form a seal around the cover cap. The O-ring, after it is installed within its groove, is subject to damage when the cover cap is forced past the O-ring during the installation phase prior to insertion of the snap ring to retain the cover cap within the lubricant reservoir cavity. Another patent issued to Hughes Tool Company, U.S. Pat. No. 4,276,946, utilizes an identical cover cap retention device that is subject to the same O-ring damage as the foregoing patent.

U.S. Pat. No. 4,161,223, assigned to the same assignee as the present application, describes a manual venting and pressure relief system located within a lubrication reservoir cavity of a sealed bearing rock bit. The lubricant system is provided in each leg of a three leg rotary cone rock bit to provide lubricant to the bearing areas between the cutter and the leg. The lubrication system includes a reservoir of lubricant that is retained within a rubber boot molded around a metal stiffening sleeve. A cover cap is attached to the rubber boot. The boot is in the form of a resilient membrane and is exposed through the cover cap to the exterior of the rock bit. The vent and pressure relief system comprises an annular seat formed in the wall of the reservoir. A valve face is formed on the rubber boot and is biased against the annular seat by means of a belleville spring acting on the cover cap. Any excessive pressure developed during operation of the bit within the lubricant reservoir is blown off through the valve seat. Any internal pressures can also be manually vented, without removing the cover cap, by prying the cap away from its seat.

Still another patent, U.S. Pat. No. 4,388,984, assigned to the same assignee as the present application, teaches a pressure relief system similar to the foregoing system with the difference being that the reservoir system is a two-stage vent system for a rock bit which relieves low pressure gases in a first stage and higher pressure gases in a second stage.

The '223 and '984 references both relieve pressures externally through the reservoir cover cap of the rock bit. The instant invention senses differential pressure across the boot through an opening in the dome of the bit as is taught in both of the Hughes' references.

The present invention teaches the use of a two-piece canister device that protects a packing gland, such as an O-ring seal, while assuring positive sealing during assembly of the pressure relief system within a rock bit. The instant invention also utilizes a dome venting system in combination with the two-piece canister device for the relief mechanism.

SUMMARY OF THE INVENTION

It is an object of this invention to provide a two-piece cover cap pressure relief valve for sealed bearing rock bits.

More specifically, it is an object of this invention to provide a two-piece pressure relief valve, the lubricant reservoir being vented to the dome of a sealed bearing rock bit. The O-ring, to prevent leakage of lubricant past the cover cap, is positioned between the two elements of the cover cap to prevent damage to the O-ring during installation of the lubricant system.

A pressure compensation lubricant reservoir mechanism is disclosed for a sealed bearing rotary cone rock bit. A rock bit body forms an open-ended lubrication cavity therein. The body further forms lubrication conduits that lead from the cavity to one or more rock bit bearings. Another conduit leads from the base of the cavity to a dome portion formed by the rotary cone rock bit body.

An expandable boot is utilized. The boot forms a boot retention flange at an open end thereof. The boot flange seats against a shoulder portion formed by the bit body within the lubricant reservoir cavity. A first hollow canister, forming first and second ends, is shaped to fit within the cavity. A second end of the canister seats against the boot flange. A second cover cap canister, having first and second ends, is shaped to complement the first canister. The second end of the second cover cap canister forms an annular recessed L-shaped receptacle. The receptacle accepts a resilient packing gland, such as an elastic O-ring, therein. The second end of the cover cap seats against the first end of the first canister to close out the L-shaped receptacle to retain the packing gland or O-ring within the receptacle.

A spring biasing means is positioned adjacent the first end of the cover cap canister. The spring biasing means is retained by a cover cap retainer, such as a snap ring. The cover cap retainer or snap ring is retained within a cover cap retention means, such as an annular slot or groove, formed within the cavity opening by the rock bit body. The spring biasing means serves to bias the cover cap and the first canister against the boot flange. The resilient packing gland or O-ring is positionable within the reservoir cavity without damage to the gland during an assembly process of the lubricant mechanism, thereby assuring a cover cap seal for the lubricant reservoir.

The means to bias the cover cap against the boot is a belleville spring.

An advantage then over the prior art lubricant reservoir systems is the ability to assemble the pressure compensating mechanism without damage to vulnerable packing rings or O-ring seals.

The above noted objects and advantages of the present invention will be more fully understood upon a study of the following description in conjunction with the detailed drawings

DESCRIPTION OF THE PREFERRED EMBODIMENTS AND BEST MODE FOR CARRYING OUT THE INVENTION

Figure 1:
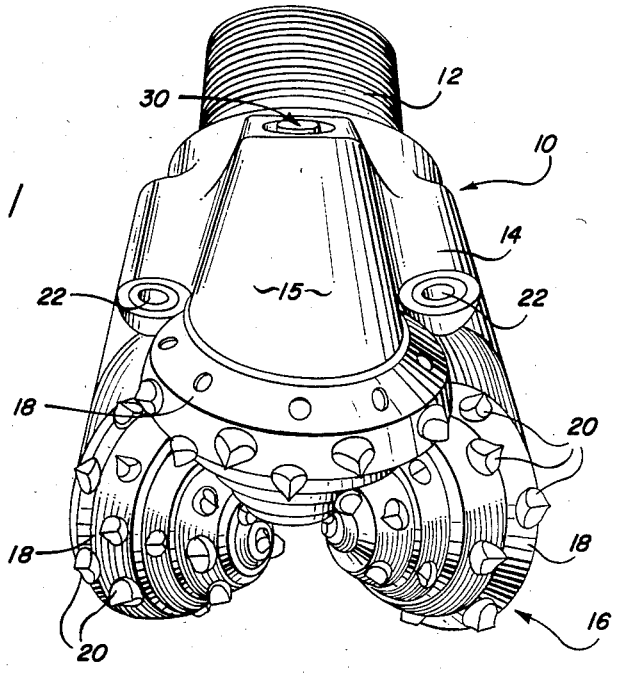
FIG. 1 is a perspective view of a typical sealed bearing rotary cone rock bit.

Turning now to FIG. 1, the sealed bearing rotary cone rock bit, generally designated as 10, consists of a pin end 12, a rock bit body 14 and a cutting end, generally designated as 16. The cutting end 16 comprises roller cutter cones 18 mounted to rock bit leg segments 15. Each of the cones has a multiplicity of, for example, tungsten carbide inserts 20 inserted therein. Each of the legs 15 encompasses a lubricant reservoir system, generally designated as 30. The lubricant reservoir mechanism serves to provide a supply of lubricant to the bearing surfaces formed between the cone and a journal extending from each of the legs 15.

Figure 2:
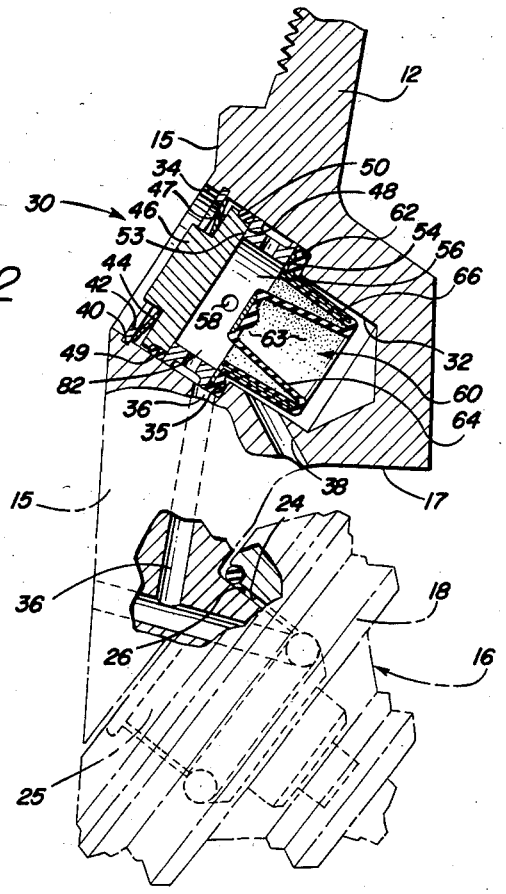
FIG. 2 is a partially cut-away cross section of one leg of the rock bit of FIG. 1, illustrating the lubricant reservoir mechanism as it is retained within a cavity formed by the leg of the rock bit.

Turning now to FIG. 2, each leg 15 of the rock bit 10 forms a lubricant cavity 32. The cavity forms an opening 34 that is exposed to the exterior of the bit. A reduced cross section area 33 is separated by a shoulder portion 35 formed in the leg 15. The cavity 32 communicates with bearing surfaces of the bit 10 through conduit 36 in leg 15. The conduit 36 leads to passages that end adjacent bearing surfaces formed between the cone 16 and journal 25 cantilevered from the leg portion 15. The passages provide lubricant between bearing surfaces 24 of cone 16 and journal bearing 26 of journal 25. The cavity 32 further communicates with the borehole environment through a passage between the cavity 32 and the dome portion 17 of bit body 14.

A pressure compensating resilient boot, generally designated as 60, is placed within cavity 32 during assembly of the pressure compensating lubrication system 30. The convoluted boot 60 serves to isolate the lubricant from the borehole environment sensed through conduit 38 during bit operation. The boot is, for example, fabricated from a resilient material such as nitrile rubber. The convoluted boot itself is preferably molded around a metal stiffening sleeve 66. The sleeve 66 extends only partway down the length of the boot. The unsupported portion 64 is convoluted or wrapped within itself to form inner and outer concentric portions. This configuration provides a means for expansion of the boot during the reservoir filling process. After the reservoir mechanism is installed, the reservoir is filled with grease. As stated before, the boot is partially supported by a cylindrical member 66 adjacent the outer portion of the boot. The metal cylinder 66 has a flanged end 67 that is attached to a flanged boot portion 62. The rim portion or flange 62 is semicircular or torroidal in configuration to form a partial compressible O-ring adjacent the metal flange 67. The convoluted or inner doubled-over portion 64 of the boot 60 is not supported. The resilient section 64 remains flexible so that it may move during the grease loading procedure or during the pressure compensating phase as the rock bit works in a borehole. The end of the boot 60 is encased in a cylindrical metal portion to protect the end of the boot in the event the boot should bottom out either against the cover cap 46 or the bottom of the cavity 32 formed in the bit body.

The stiffening sleeve 66 may be fabricated from a material other than metal and need not be encapsulated so long as it supports the outer portion of the convoluted expandable boot.

An inner canister portion 52 is formed in a cylindrical ring having a first mating surface 53 and a second mating surface 54. The surface 54 of canister 52 mates with the boot 60 at flange 62–67. The canister 52 has, for example, a series of equidistantly spaced holes 58 that serve as a means to transmit lubricant from the lubricant reservoir 30 to the bearing surfaces communicating with passage 36. The openings 58 communicate with an annular recessed channel 51 formed in the outer wall of canister 52 to assure adequate flow of lubricant from the interior of the lubricant reservoir to the passage 36 and from there to the bearing surfaces 24 and 26 formed between journal 25 and cone 18.

A cover cap canister 46 serves to close out the lubricant reservoir cavity during assembly of the reservoir mechanism. Cover cap 46 has formed on its lower peripheral edge 48 an L-shaped receptacle 49 therearound. The receptacle 49 is designed to accept a resilient packing gland, such as an O-ring 50, installed during the installation of the reservoir mechanism. The cover cap 46 is retained within cavity 32 by, for example, a snap ring 42. The snap ring 42 is retained within an annular groove 40 formed within leg 15. Between the snap ring and the outside surface 47 of cover cap 46 is positioned a spring means. The spring means is, for example, a belleville spring 44. The preferred belleville spring serves to provide pressure against the cover cap to assure a positive force against the inner canister 52 and the flange 62 and 67 of the resilient boot 60.

It would be obvious to provide a threaded cover cap retention device in place of the preferred snap ring.

It would be obvious as well to utilize a coiled spring in place of the preferred belleville spring to bias the cover cap positively against the inner components of the reservoir system 30.

The packing gland may be formed from a deformable material well-known in the art. Additionally, the preferred O-ring may be fabricated from rubber or synthetic elastic compound such as nitrile.

During installation the boot 60 is first inserted within cavity 32, the flange portions 62 and 67 seating against the shoulder 35 formed in the leg 15. The canister 52 is then inserted on top of the flange 67, followed by placement of the O-ring 50. Since the O-ring 50 is in a free state, it merely is inserted or placed within the cavity 32. The O-ring rests on top of surface 53 of canister 52. The O-ring therefore cannot be damaged during its installation phase.

In prior art pressure compensating assembly methods, as heretofore stated, an O-ring is usually placed within a U-shaped O-ring channel formed in a cover cap or formed in the body. Insertion of the cover cap past the O-ring or in the alternative (the O-ring being in the cover cap), the O-ring is passed over a groove for a snap ring, often causing damage to the sealing edge of the O-ring during the installation phase. In the present invention, the O-ring is simply placed within the cavity, on top of surface 53, followed by insertion of the cover cap 46. The L-shaped groove 49 at the base 48 of cover cap 46 slips over the inner peripheral edge of the O-ring, the O-ring being then trapped between the L-shaped groove 49 and the surface 53 of inner canister 52. The belleville spring 44 is then placed over the cover cap surface 47, followed by the final insertion of the snap ring 42 within a groove 40. The belleville, again, provides a force on the cover cap 46, canister 52 and flanges 62 and 67, thereby providing an assembly that is characterized by its tightly mated members.

The lubricant reservoir 30 is filled with a lubricant through a side port (not shown) that intersects passage 36 in leg 15. Grease is forced into passage 36 through openings 58 in the inner canister 52, filling the internal cavity, forcing the convoluted portion 64 of resilient boot 60 toward the bottom of the cavity 32.

During operation of the rock bit in the borehole, external pressures are felt across the resilient boot 60 through the channel 38 in the dome of the boot. Any excess or increased pressure will be felt across the boot 60, thus assuring a flow of lubricant from the internal reservoir of the system to the bearing surfaces of the rock bit. Conversely, any internal pressures are felt across the boot, expanding the boot within cavity 32.

Figure 3:
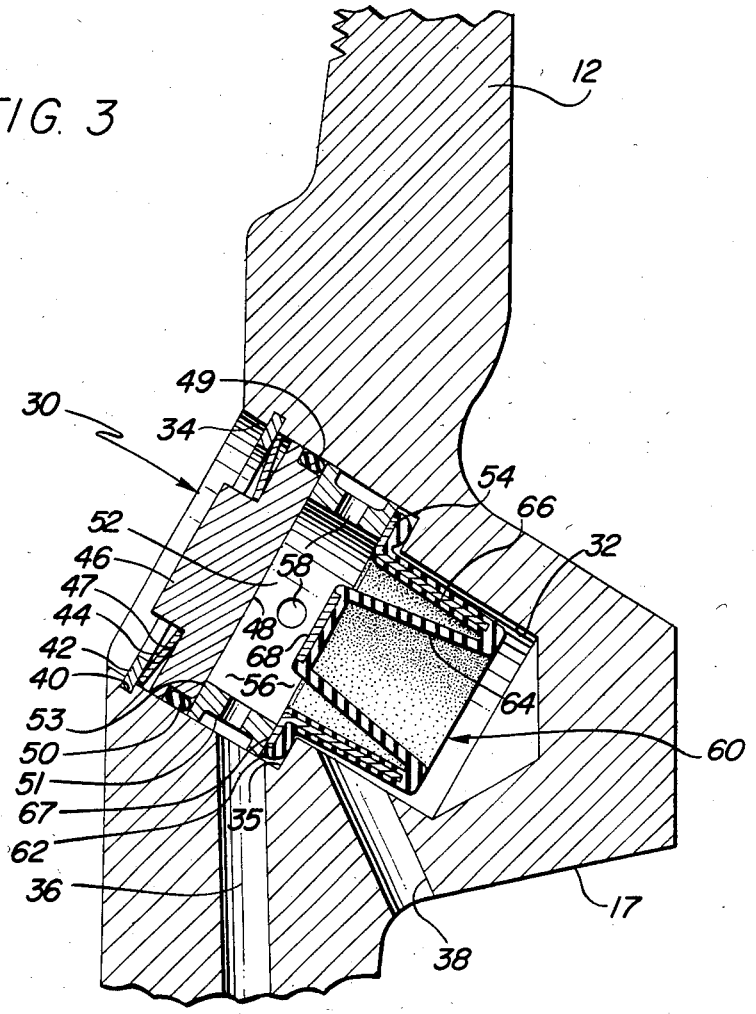
FIG. 3 is a partially cut-away enlarged section of one leg of the rotary cone rock bit, illustrating in greater detail the various parts of the lubricant reservoir system.

FIG. 3 illustrates the lubricant reservoir and relief system 30 in greater detail, illustrating the relationship of the resilient boot 60, the inner canister 52 and the cover cap 46. It can clearly be seen in this view that the O-ring 50 is in no jeopardy during the installation phase of the cover cap 46 into the cavity 32. The O-ring follows insertion of the boot 60 and the canister 52. The cover cap is then placed over the O-ring 50; the O-ring gland 49 being formed in the base 48 of cover cap 46. The belleville spring is energized by the snap ring 42, positioned within its retention groove 40 in leg 15. The whole assembly is thereby biased toward the bottom of the reservoir cavity 32 by the belleville spring, thus assuring a tightly sealed mechanism. The O-ring 50 assures that lubricant will remain within the reservoir system and will not leak to the exterior of the rock bit during bit operating conditions.

As stated before, the prior art reservoir systems suffer from damage to the vital O-ring seal during the installation of the lubricant reservoir mechanism. The slightest loss of grease through a faulty O-ring seal can quickly be catastrophic to the rock bit operation.

It will of course be realized that various modifications can be made in the design and operation of the present invention without departing from the spirit thereof. Thus, while the principal preferred construction and mode of operation of the invention have been explained in what is now considered to represent its best embodiments, which have been illustrated and described, it should be understood that within the scope of the appended claims, the invention may be practiced otherwise than as specifically illustrated and described.

What is claimed is:

1. A pressure compensation lubricant reservoir mechanism for a sealed bearing rotary cone rock bit comprising:

a rock bit body, said body forming an open-ended lubrication cavity therein, said body further forming lubrication conduits from said cavity to one or more rock bit bearings and at least one channel formed by said body communicating from said cavity to a dome portion formed by said rock bit body, an expandable boot forming a boot retention flange at an opened end thereof, said boot flange seats against a shoulder portion formed by said body within said cavity, a first hollow canister having first and second opened ends shaped to fit within said cavity, said second end of said canister seats against said boot flange, a second cover cap canister having first and second ends, shaped to complement said first canister, said second end of said cover cap forming an annular recessed L-shaped receptacle therearound, said receptacle accepts a resilient packing gland therein, said second end of said cover cap seats against said first end of said first canister to close out said L-shaped receptacle for said packing gland, and spring biasing means adjacent said first end of said cover cap canister, said spring means is positioned between a cover cap retainer, said cover cap retainer is retained within a means formed in said bit body within said cavity, said spring means biases said second cover cap canister and said first canister against said boot flange, the resilient packing gland being positionable within said reservoir cavity without damage during an assembly of said lubricant reservoir mechanism thereby assuring a cover cap seal for said lubricant reservoir.

2. The invention as set forth in claim 1 wherein said expandable boot is formed from an elastic rubber material.

3. The invention as set forth in claim 2 wherein said expandable boot is formed from a synthetic nitrile compound.

4. The invention as set forth in claim 1 wherein said packing gland is an O-ring.

5. The invention as set forth in claim 4 wherein the O-ring is formed from rubber.

6. The invention as set forth in claim 5 wherein the O-ring is formed from a synthetic nitrile compound.

7. The invention as set forth in claim 1 wherein the spring biasing means is a belleville spring.

8. The invention as set forth in claim 7 wherein the spring biasing means is a coiled spring.

9. The invention as set forth in claim 1 wherein the cover cap retainer is a snap ring, said cover cap retainer means formed by said bit body within said cavity is an annular groove that retains said snap ring.

10. The invention as set forth in claim 1 wherein said expandable boot is convoluted forming outer and inner portions, said outer and inner portions being substantially concentric, the inner portion of said boot is closed off to retain a lubricant therein.

11. The invention as set forth in claim 10 wherein said expandable boot has a rigid cylindrical ring adjacent said outer portion forming a flange at one end, the flange complements said boot retention flange, said cylindrical ring extends partway down the length of the boot and serves to support and reinforce said outer portion of said expandable boot.

12. The invention as set forth in claim 11 wherein said rigid cylindrical ring is encapsulated within said outer portion of said expandable boot.

13. The invention as set forth in claim 12 wherein said rigid cylindrical ring is formed of metal.

14. The invention as set forth in claim 1 wherein said boot retention flange at an opened end thereof is formed in a torroidal shape, said flange acting as a deformable O-ring upon assembly of the reservoir mechanism.

15. A pressure compensation lubricant reservoir mechanism for a sealed bearing rotary cone rock bit comprising:

a rock bit body, said body forming an open ended lubrication cavity therein, said body further forming lubrication conduits from said cavity to one or more rock bit bearings and at least one channel formed by said body communicating from said cavity to a dome portion formed by said rock bit body, an expandable boot forming a boot retention flange at an opened end thereof, said boot flange seats against a shoulder portion formed by said body within said cavity, a first hollow canister having first and second opened ends shaped to fit within said cavity, said second end of said canister seats against said boot flange, a second cover cap canister having first and second ends, shaped to complement said first canister, said second end of said cover cap forming an annular recessed L-shaped gland therearound, said gland accepts an elastic O-ring therein, said second end of said cover cap seats against said first end of said first canister to close out said L-shaped gland for said O-ring, and spring biasing means adjacent said first end of said cover cap canister, said spring means is positioned between a snap ring cover cap retainer, said snap ring being retained within an annular groove formed in said bit body within said cavity, said spring means biases said second cover cap canister and said first canister against said boot flange, the O-ring being positionable within said reservoir cavity without damage during an assembly of said lubricant reservoir mechanism thereby assuring a cover cap seal for said lubricant reservoir.

* * * * *